US006422740B1

(12) United States Patent
Leuenberger

(10) Patent No.: US 6,422,740 B1
(45) Date of Patent: Jul. 23, 2002

(54) WRISTWATCH

(75) Inventor: Claude-Eric Leuenberger, Genève (CH)

(73) Assignee: Montres Rolex S. A., Geneve (CH)

( * ) Notice: Subject to any disclaimer, the term of this patent is extended or adjusted under 35 U.S.C. 154(b) by 0 days.

(21) Appl. No.: 09/650,028

(22) Filed: Aug. 28, 2000

(30) Foreign Application Priority Data

Sep. 1, 1999 (EP) ..... 99810783

(51) Int. Cl.[7] ..... G04B 27/02

(52) U.S. Cl. ..... 368/320; 368/190; 368/308; 368/319; 368/321

(58) Field of Search ..... 368/69, 185, 187, 368/308, 319–321, 190

(56) References Cited

U.S. PATENT DOCUMENTS

| | | | | |
|---|---|---|---|---|
| 2,906,832 A | | 9/1959 | Foster et al. | |
| 3,647,994 A | * | 3/1972 | Vozenilek | 200/4 |
| 3,975,896 A | * | 8/1976 | Kasama | 368/319 |
| 4,034,553 A | * | 7/1977 | Wuthrich | 368/320 |
| 4,336,446 A | * | 6/1982 | Hafner | 368/187 |
| 4,379,642 A | * | 4/1983 | Meyrat | 368/321 |
| 4,419,018 A | * | 12/1983 | Meyrat | 368/69 |

FOREIGN PATENT DOCUMENTS

| | | |
|---|---|---|
| CH | 637 521 | 8/1983 |
| FR | 2 444 334 A | 7/1980 |
| FR | 2 530 801 A | 1/1984 |
| GB | 2 070 815 | 9/1981 |
| GB | 2 071 881 A | 9/1981 |

* cited by examiner

*Primary Examiner*—Vit Miska
*Assistant Examiner*—Jeanne-Marguerite Goodwin
(74) *Attorney, Agent, or Firm*—Davis & Bujold, P.L.L.C.

(57) ABSTRACT

The present invention concerns a wristwatch type of watch. More specifically, the watch comprises a display (11), an electronic circuit (12) controlling the display, a time set stem (13), and at least two electrical contact elements (14, 14"). The time set stem (13) can be placed in different axial positions and the stem comprises a crown (16) accessible from outside the watch and a helicoidal zone (19) which may have three helicoidal elements (20, 20', 20"). When the time set stem is placed in a position such that the contact elements (14, 14") are facing the helicoidal zone (19), rotating the time set stem causes an electrical connection on the electronic circuit (12) to alternately open and close. This generates at least two electrical impulse signals which are transmitted to the electronic control circuit. These signals are used to regulate different watch functions, such as time correction or controlling the time belt or the date.

20 Claims, 3 Drawing Sheets

WRISTWATCH

TIME SET STEM WITH HELICOIDAL CONTACT STRUCTURE

The present invention concerns a wristwatch type watch, consisting of a display, such as an analog time display, an electronic circuit controlling the display, a time set stem, and at least two electrical contact elements, each alternately opening and closing one electrical connection in said electronic circuit when the time set stem is rotated and generating at least two electrical impulse signals which are transmitted to said electronic control circuit.

BACKGROUND OF THE INVENTION

Numerous watches already exist, particularly wristwatches with analog time displays and electronic controls for the watch functions. In particular, British Patent Application Publication No. 2 070 815 and Swiss No. 637 521 describe such watches.

These watches comprise a time set stem which is partially square in section. Along the squared portion there are two cams which may be either square, rectangular, triangular, or elliptical in shape. The two cams are angularly offset from each other and attached to the stem in such a way that rotating the time set stem causes the cams to rotate. The cams are also located near two flexible conductive plates which alternately open and close electrical connections when displaced by the rotating cams. As a result, when the cams rotate, electrical impulse signals are generated, which alternate from being open to being closed, and vice versa, over a period of time.

The angularly offset position of the cams and the use of two electrical contacts make it possible to distinguish the direction in which the time set stem is rotating, in a manner known in the art.

The time set stem can generally be placed in different longitudinal positions in order to access various watch functions. For this purpose, the cams slide along the square section of the time set stem so that they always remain facing the conductive plates, regardless of the longitudinal position of the set stem.

This embodiment has several disadvantages. First, the square section of the time set stem must be large enough to hold the cams. Second, the cams require a considerable amount of space. This creates a particular problem with smaller watches such as ladies' watches or very flat watches.

The cams must be positioned on the stem in a certain direction so that if the stem rotates in a given direction, the electronic circuit will not interpret it as a rotation in the opposite direction. Furthermore, given the size of the cams, assembly is clearly complex.

Because the cams must remain facing the conductive plates, a cam maintenance element must be located in a given longitudinal position, regardless of the longitudinal position of the time set stem. This element further complicates the assembly process.

Finally, in order for the cams to slide longitudinally along the time set stem, they must be attached to it with a certain degree of play. This introduces hysteresis in the electrical control signals.

This hysteresis must be electronically processed, which complicates the signal processing unit.

SUMMARY OF THE INVENTION

The present invention proposes a watch which overcomes these difficulties through the use of a time set stem that has no sliding cams, but allows access to its functions in the same manner as watches with sliding cams.

This object is achieved by a wristwatch such as the watch defined in the preamble, characterized in that at least one part of the time set stem includes at least one helicoidal portion cooperating with said electrical contacts to alternately open and close an electrical connection on the electronic circuit when the time set stem is rotated.

According to a first embodiment, the time set stem comprises two helicoidal portions.

According to a second embodiment, the time set stem comprises three helicoidal portions.

Said helicoidal portions are advantageously angularly offset at constant intervals.

According to a particular embodiment of the invention, the spaces between the spirals along each helicoidal element are constant.

The electrical contact elements are preferably separated by a given fixed distance (d).

According to a preferred embodiment, the spacing of the helices along the helicoidal elements, the angular separation between the elements, and the distance (d) separating the electrical contact elements are calculated so that the electrical signals formed by the alternate opening and closing of each electrical contact element when the time set stem is rotated at constant speed have a cyclical relationship ranging from 30% to 70% and are essentially equal to about 50%.

The spacing of the helices along the helicoidal elements, the angular separation between the elements, and the fixed distance (d) separating the electrical contact elements are calculated so that the electrical signals formed by the alternate opening and closing of each electrical contact element when the time set stem is rotated at constant speed are essentially in quadrature.

In one advantageous mode of the invention, wherein the time set stem can be placed in at least two different longitudinal positions, each electrical contact element cooperates with the time set stem zone that has at least one helicoidal portion at each longitudinal position on the time set stem, except a maximum of one set stem position.

BRIEF DESCRIPTION OF THE DRAWINGS

The advantages of the present invention will be better understood with reference to the various embodiments of the invention and the attached drawings, wherein.

DESCRIPTION OF THE PREFERRED EMBODIMENTS

Figure 1:
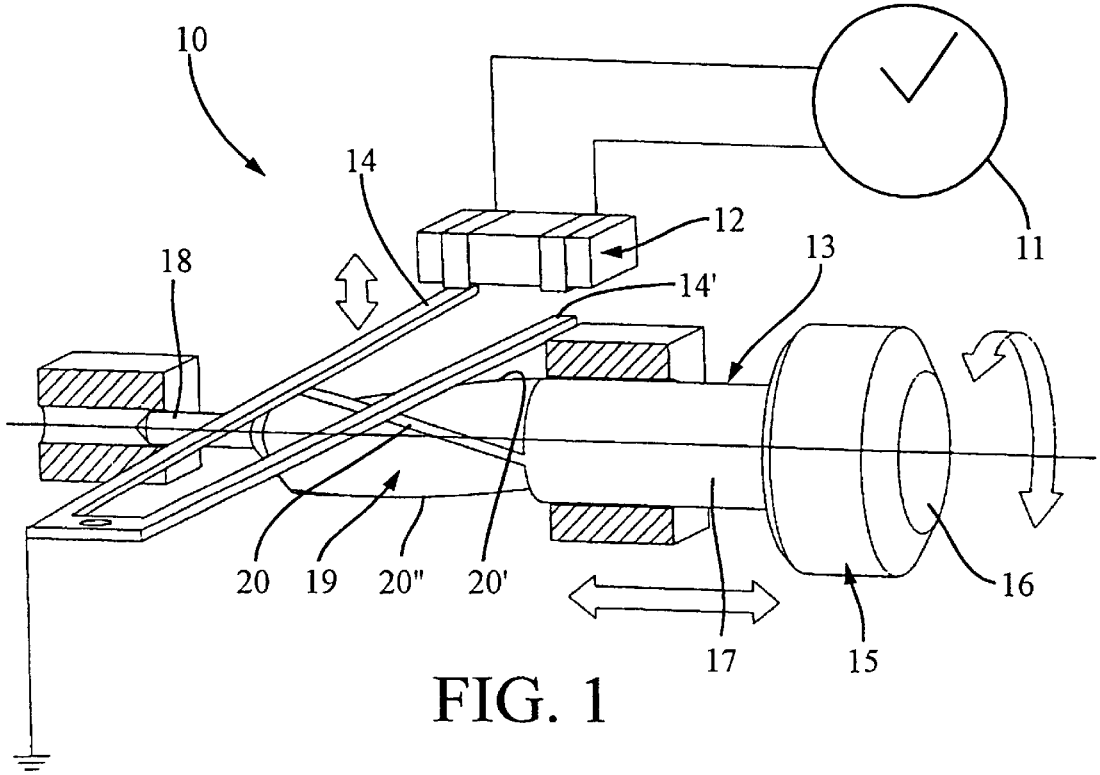
FIG. 1 is a perspective of a time set stem and the elements associated with it, such as those used in a wristwatch according to the present invention.
Figure 2:
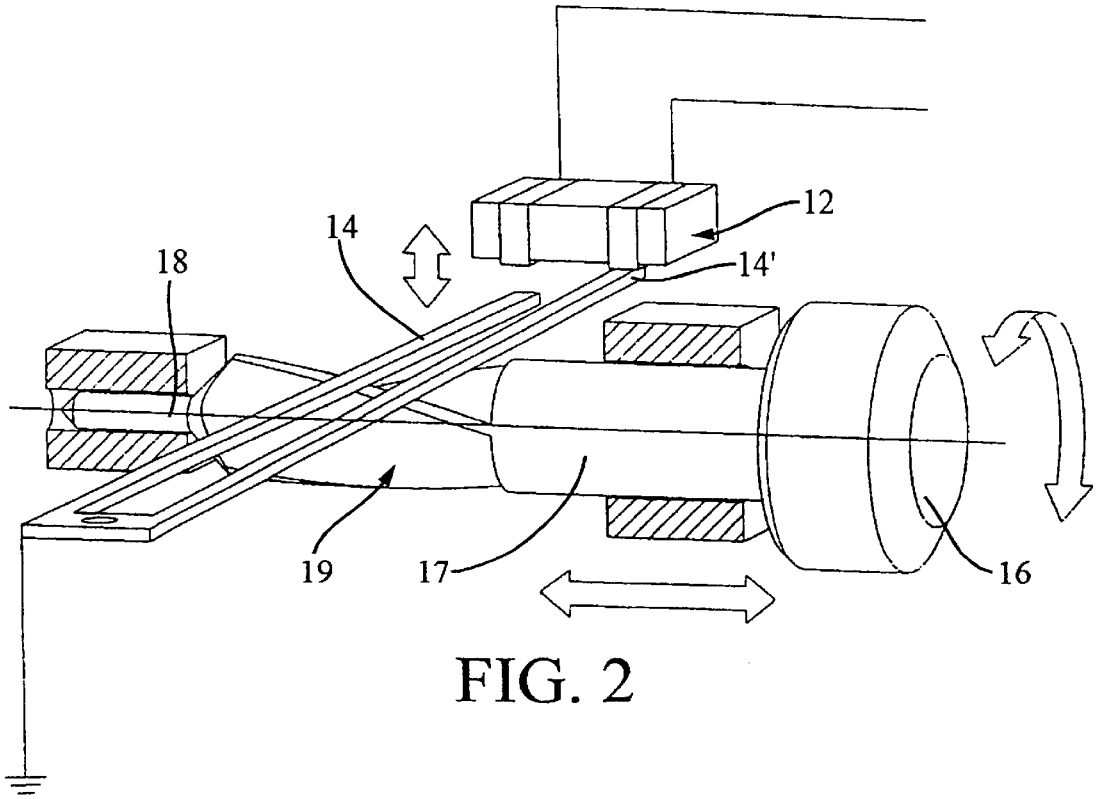
FIG. 2 is a view similar to FIG. 1, with the time set stem in a different position.

With reference to the drawings, and particularly to FIGS. 1 and 2, watch 10 according to the present invention specifically comprises a display 11 such as an analog or a digital time display, an electronic circuit 12 controlling said display, a time set stem 13, and two electrical contact elements 14, 14'. In the embodiments shown, these electrical contact elements are flexible conductive plates.

Time set stem 18 is generally formed of four zones. One zone 15 comprises a time set crown 16 accessible from the exterior of the watch, allowing the user to rotate the time set stem and thus to access certain watch functions. The stem also has two cylindrical zones a large diameter cylindrical zone 17 and a small diameter cylindrical zone 18 to guide both the rotating and translating movement of the time set stem. Finally, the times set stem comprises a zone 19 with at least one helicoidal element, hereinafter called helicoidal zone 19. The at least one helicoidal element (20, 20', 20", 24, 24') forms less than one complete 360 degrees wrap around the time set stem (13).

Figure 3A:
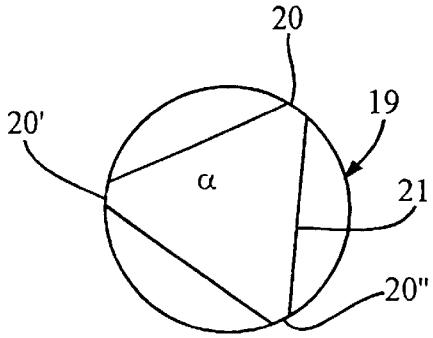
FIGS. 3A, 3B, 3C and 3D are transverse cross-sections of different embodiments of time set stems such as those used in the watch according to the invention.
Figure 3B:
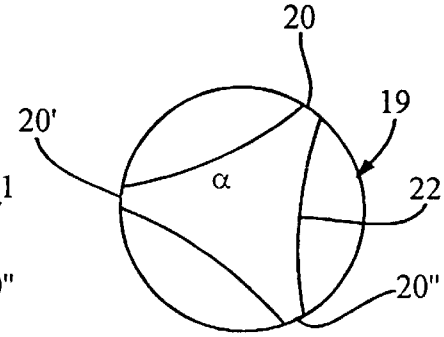
Figure 3C:
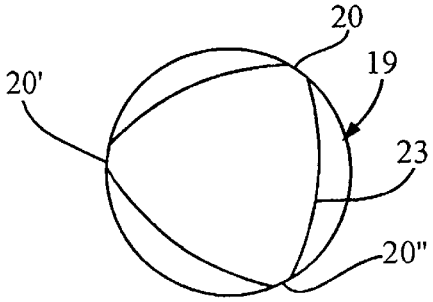

In the embodiments shown in FIGS. 3A through 3C, which are transverse cross-sections of the helicoidal zones 19 of different time set stems, said zone comprises three helicoidal portions 20, 20', 20".

FIG. 3A shows a first embodiment of helicoidal zone 19 on the time set stem. This zone is a regular surface, which means that each section perpendicular to the longitudinal stem axis is defined by straight segments 21. This embodiment simplifies manufacture.

FIG. 3B shows an embodiment wherein the sections of helicoidal zone 19 on said set stem are defined by arcs 22.

Finally, in the embodiment shown in FIG. 3C, these segments are defined by a slightly convex curve 23. It is obvious that other types of curves could be used. The shape of these segments is essentially determined by the method used to manufacture the set stem.

Figure 3D:
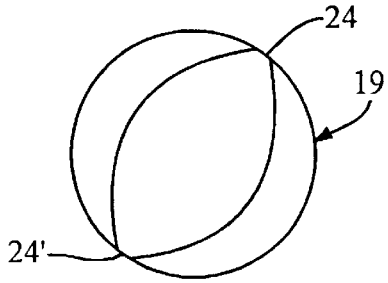

The embodiment shown in FIG. 3D comprises two helicoidal portions 24, 24' for displacing the electrical contact elements.

The operation of helicoidal zone 19 is explained in detail below with reference to FIGS. 5, 6 and 7.

Figure 4:
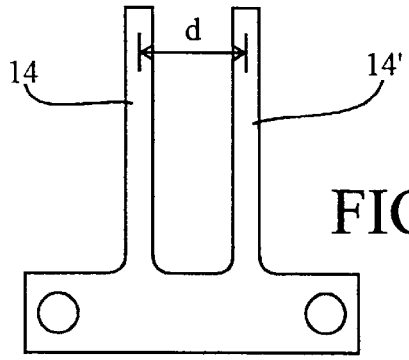
FIG. 4 is a detailed view of the electrical contact elements such as those shown in FIGS. 1 and 2.

FIG. 4 shows the two electrical contact elements 14, 14'. According to a particularly advantageous embodiment, these contact elements are formed of two flexible, electrically conductive plates and separated by a fixed distance (d). These contact elements are preferably made as a single piece so that the fixed distance d between the two plates cannot be changed during installation in the watch. However, It is also possible to form the contacts independently and to install them so that fixed distance (d) is maintained.

Electrical contact elements 14, 14' are installed in the watch in such a way that they alternately open and close electrical circuit connections on electronic circuit 12 when the helicoidal element displaces the contacts. The assembly of the electrical contact elements is similar to the conventional assembly using two sliding cams.

Figure 5A:
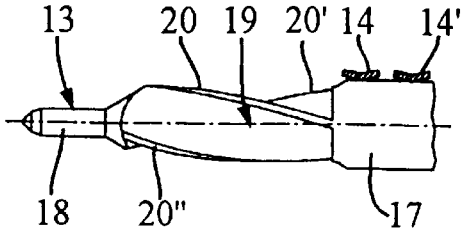
FIGS. 5A, 5B and 5C illustrate the time set stem in three different positions according to a first embodiment.
Figure 5B:
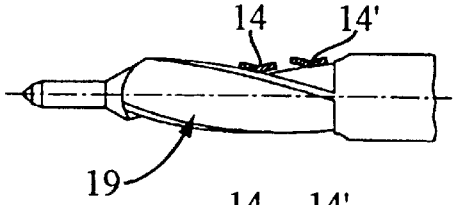
Figure 5C:
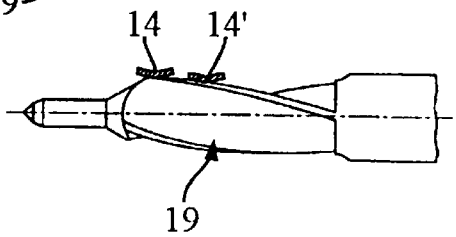

FIGS. 5A, 5B and 5C show a time set stem in three different possible longitudinal positions.

In FIG. 5A, the time set stem is completely pushed inside the watch case. The two contacts 14, 14' rest on cylindrical stem zone 17. Rotating the stem does not cause the electrical connections to open or close. Thus, this corresponds to a "neutral" contact position. The diameter of cylindrical zone 17 is such that electrical connections are always established. To minimize electricity consumption due to these connections, it is possible to stop the electricity supply if the contacts remain immobile for a predetermined length of time.

In FIG. 5B, the time set stem is shown slightly displaced toward the outside of the watch case. Helicoidal zone 19 is located facing contacts 14, 14'. Rotating the stem causes each connection to alternately open and close. This opening and closing action generates electrical signals in the form of impulses which are used in electronic circuit 12 of the watch to control various functions. Signal generation and distinguishing the direction of stem rotation are both discussed below with reference to FIGS. 7A and 7B. The use of these signals to access watch functions is not discussed in detail, since these elements are well known to a person skilled in the art.

FIG. 5C shows the time set stem displaced a considerable distance toward the outside of the watch case. Helicoidal zone 19 remains facing contacts 14, 14'. Thus, electrical signals in the form of impulses can once again be generated by rotating the stem, with identical dephasing and thus independent of the axial stem position.

The embodiment shown in FIGS. 6A, 6B, 6C and 6D is similar to that shown in FIGS. 5A, 5B and 5C. Set stem 13, however, can be displaced in four different longitudinal positions. In the position shown in FIG. 6A, with the stem pushed toward the inside of the watch, contacts 14, 14' are located in cylindrical zone 17, but they are not displaced by this zone. At least one helicoidal element cooperates with the time set stem in all the positions excepting a maximum of one stem position. In this position the connections remain permanently open and therefore consume no energy.

Figure 6A:
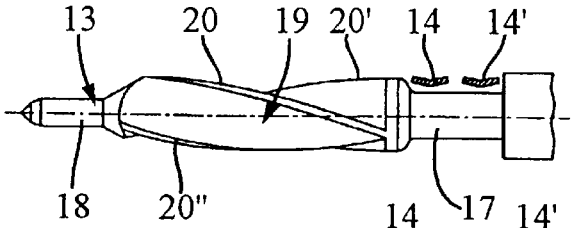
FIGS. 6A, 6B, 6C and 6D show the time set stem in four different positions according to a second embodiment.
Figure 6B:
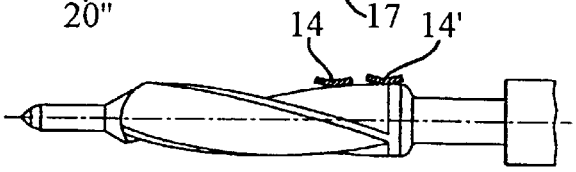
Figure 6C:
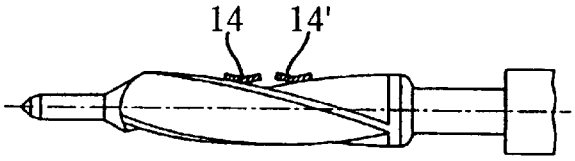
Figure 6D:
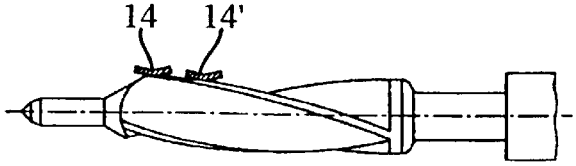

In the three other stem positions shown by FIGS. 6B, 6C and 6D, respectively, contacts 14, 14' are located facing helicoidal zone 19 which, as before, allows electrical signals to be generated when the stem is rotated.

Figure 7A:
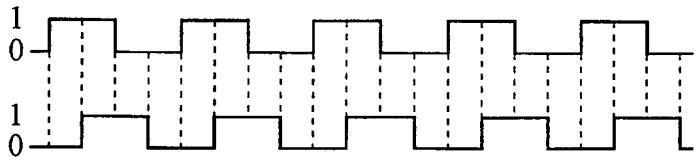
FIGS. 7A and 7B show the electrical signals obtained when the time set stem is rotated a constant speed in two different directions.
Figure 7B:
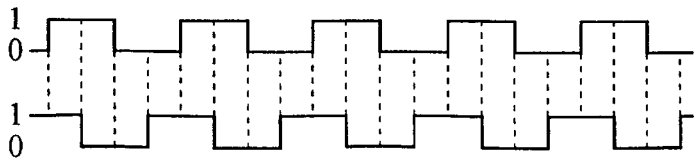

FIGS. 7A and 7B show the electrical signals obtained when the set stem is rotated at a constant speed, as shown in FIG. 3A, for example.

The upper portion of these drawings shows a signal generated by contact element 14 and the lower portion shows the signal generated by contact element 14'.

In order to reliably distinguish the direction of rotation, it is essential that the signals generated when the stem is rotated in one direction differ from those generated during rotation in the opposite direction.

For optimal distinction, it is desirable, but not necessary, that each contact be closed for essentially the same length of time it is open. This would be a cyclical relationship equal to about 50%. Morever, it is desirable that switching one of these contacts occur essentially in the middle of the period during which the other contact remains in a given stable state. For example, of one of the contacts is switched every 0.2 seconds, it is desirable for the other contact to be switched 0.1 seconds later each time the first contact is switched.

In this configuration, the electrical signals are called "quadrature" . In an arrangement such as that shown in FIGS. 3A, 3B and 3C, this condition is fulfilled when the interval of the helicoidal section is such that the angle traversed circularly by a rib along a distance (d) is equal to 30°. In an arrangement such as the one shown in FIG. 3D, the interval should be 45°. This configuration minimizes the risk of false switching detection and thus ensures correct interpretation of electrical signals.

FIG. 7A, for example, shows the signals resulting from a clockwise rotation of the time set stem. This drawing demonstrates that the transition from logical 0 to logical 1 by the first contact is followed by transition from logical 0 to logical 1 by the second contact.

When the time set stem is rotated in the counterclockwise direction, as shown in FIG. 7B, the transition from logical 0 to logical 1 by the first contact is followed by transition from logical 1 to logical 0 by the second contact.

By determining what transition is produced on the second contact when transition from the 0 state to the 1 state is produced on the first contact, it is possible to determine the direction in which the stem is rotating.

The present invention offers numerous advantages over prior art devices.

Set stem 13 is formed of a single piece without any sliding elements such as cams or moving pinions. This results in fewer pieces to manufacture and simplifies watch assembly greatly.

It is possible for helicoidal zone 19 to have a regular surface, which also simplifies stem manufacture.

In addition, helicoidal zone 19 is larger in section than the square shaped prior art stems. This makes it more rugged by increasing mechanical resistance in relation to its small size.

The total length of the stem may also be reduced, as it is no longer necessary to provide play for slidable cams. This frees up space within the watch, which is particularly desirable in small size watches.

The positioning of contacts 14, 14' need not be particularly precise. It is merely necessary for distance (d) between the contacts to conform to the intervals along the helix on the helicoidal stem zone. This is quite simple to do with commonly used methods of making contacts.

Finally, given the fact that there is no angular play between the zones to displace the contacts and rotate the stem, the electrical signals are not subject to hysteresis and they are easier to process. This allows use of a simplified electronic processing circuit.

The present invention is not limited to the embodiments described, but extends to any variation or modification obvious to one skilled in the art. In particular, the shape of the helicoidal zone may be modified, so long as it allows the contacts to be displaced when the stem is rotated. It is actually possible to use two or four helicoidal elements, for example, instead of the three elements shown in FIGS. 3A through 3C. It is also possible to use only one contact if it will not be necessary to determine the direction of stem rotation. This would allow translational stem displacement, since in the absence of rotation such a displacement would reverse the state of the contact.

Moreover, the intervals on the helix may vary along the helicoidal zone. This would permit the axial position of the time set stem to be determined. The time lag between the signal generated by one of the contacts in relation to the lag in the signal generated by the other contact is different if the interval on the helix in the two helicoidal zones is different. More specifically, the signals maybe in quadrature when the time set stem is in a first axial position and out of quadrature when the stem is in a second axial position. Thus, signal analysis would permit determination of the axial position of the time set stem.

What is claimed is:

1. A watch comprising:

a display (11);

an electronic circuit (12) controlling operation of the display (11), and the electronic circuit having electrical contacts;

a time set stem (13); and at least two electrical contact elements (14, 14") controlled by the time set stem (13), each of the at least two electrical contact elements (14, 14") alternately opening and closing an electrical connection with one of the electrical contacts of the electronic circuit (12), when the time set stem (13) is rotated, to generate electrical impulse signals transmitted to the electronic circuit (12) for controlling operation of the display (11);

wherein the time set stem (13) has at least one helicoidal element (20, 20', 20", 24, 24') which extends along a helicoidal zone (19) of the time set stem (13), and when the time set stern (13) is sufficiently extending from the watch, the at least one helicoidal element (20, 20', 20", 24, 24') cooperates with the at least two electrical contact elements (14, 14") to move alternately the at least two electrical contact elements (14, 14") in and out of contact with the electrical contacts of the electronic circuit (12), for opening and closing the electrical connection of the electronic circuit (12), upon rotation of the time set stem (13).

2. The watch according to claim 1, wherein the time set stem (13) has two helicoidal elements (24,24') which extend along the helicoidal zone (19) of the time set stem (13).

3. The watch according to claim 2, wherein the two helicoidal elements (24, 24') are angularly offset from one another by a constant interval spacing.

4. The watch according to claim 3, wherein the time set stem (13) has two helicoidal elements (24, 24') which extend along the helicoidal zone (19) of the time set stem (13) and are angularly offset from one another by the constant interval spacing, and the at least two electrical contacts (14, 14') are separated from one another by a fixed distance (d); and the angularly offset of the two helicoidal elements (24, 24') and the distance (d) separating the electrical contact elements (14, 14") are determined so that the electrical signals formed by the alternate opening and closing of the at least two electrical contact elements (14, 14'), upon rotation of the time set stem (13) at a constant speed, have a cyclical relationship that ranges from 30% to 70%.

5. The watch according to claim 4, wherein the cyclical relationship is equal to about 50%.

6. The watch according to claim 2, wherein each of the two helicoidal elements (24, 24') has a constant helicoidal interval.

7. The watch according to claim 3, wherein the time set stem (13) has three helicoidal elements (24, 24') which extend along the helicoidal zone (19) of the time set stem (13) and are angularly offset from one another by the constant interval spacing, and the at least two electrical contacts (14, 14') are separated from one another by a fixed distance (d); and the angularly offset of the two helicoidal elements and the distance (d) separating the electrical contact elements (14, 14") are determined so that the electrical signals formed by the alternate opening and closing of the at least two electrical contact element (14, 14"), upon rotation of the time set stem (13) at a constant speed, are essentially in quadrature.

8. The watch according to claim 1, wherein the time set stem (13) has three helicoidal elements (20, 20', 20") which extend along the helicoidal zone (19) of the time set stem (13).

9. The watch according to claim 8, wherein the three helicoidal elements (20, 20', 20") are angularly offset from one another by a constant interval spacing.

10. The watch according to claim 9, wherein the time set stem (13) has three helicoidal elements (20, 20', 20") which extend along the helicoidal zone (19) of the time set stem (13) and are angularly offset from one another by the constant interval spacing, and the at least two electrical contacts (14, 14') are separated from one another by a fixed distance (d); and the angularly offset of the three helicoidal elements (20, 20', 20") and the distance (d) separating the at least two electrical contact elements (14, 14") are determined so that the electrical signals formed by the alternate opening and closing of the at least two electrical contact elements (14, 14'), upon rotation of the time set stem at a constant speed, have a cyclical relationship that ranges from 30% to 70%.

11. The watch according to claim 10, wherein the cyclical relationship is equal to about 50%.

12. The watch according to claim 8, wherein each of the three helicoidal elements (20, 20', 20") has a constant helicoidal interval.

13. The watch according to claim 9, wherein the time set stem (13) has two helicoldal elements (20, 20', 20") which extend along the helicoidal zone (19) of the time set stem (13) and are angularly offset from one another by the constant interval spacing, and the at least two electrical contacts (14, 14') are separated from one another by a fixed distance (d); and the angularly offset of the helicoidal elements and the distance (d) separating the at least two electrical contact elements (14, 14") are determined so that the electrical signals formed by the alternate opening and closing of the at least two electrical contact elements (14, 14'), upon rotation of the time set stem (13) at a constant speed, are essentially in quadrature.

14. The watch according to claim 1, wherein the at least two electrical contacts (14, 14') are separated from one another by a fixed distance (d).

15. The watch according to claim 1, wherein the time set stem (13) has at least an inoperative position and an operative position and each of the at least two electrical contacts (14, 14') cooperates with the helicoidal zone (19) of the time set stem (13) which comprises at least one helicoidal element at each of a longitudinal position of the time set stem (13), excepting a maximum of one stem position.

16. The watch according to claim 1, wherein the time set stem (13) comprises a set crown (15), two cylindrical zones (17, 18), and the helicoidal zone (19) is located between the two cylindrical zones (17, 18).

17. A watch comprising:

a display (11);

an electronic circuit (12) controlling operation of the display (11), and the electronic circuit (12) having electrical contacts;

a time set stem (13), and at least two electrical contact elements (14, 14") controlled by the time set stem (13), each of the at least two electrical contact elements (14, 14") alternately opening and closing an electrical connection with one of the electrical contacts of the electronic circuit (12), when the time set stem (13) is rotated, to generate electrical impulse signals transmitted to the electronic circuit (12) for controlling operation of the display (11);

wherein the time set stem (13) has at least one helicoidal element (20, 20', 20", 24, 24') which extends along a helicoidal zone (19) of the time set stem (13), and when the time set stem (13) is sufficiently extending from the watch, the at least one helicoidal element (20, 20', 20", 24, 24') cooperates with the at least two electrical contact elements (14, 14") to move alternately the at least two electrical contact elements (14, 14") in and out of contact with the electrical contacts of the electronic circuit (12), for opening and closing the electrical connection of the electronic circuit (12), upon rotation of the set stem (13); and the time set stem (13) comprises a set crown (15), a larger diameter cylindrical zone (17), a smaller diameter cylindrical zone (18), and the helicoidal zone (19) is located between the smaller and the larger diameter cylindrical zones (18, 17).

18. The watch according to claim 17, wherein the diameter of the larger diameter cylindrical zone (17) is substantially equal to a diameter of helicoidal zone (19) and the at least one helicoidal element (20, 20', 20", 24, 24') forms less than one complete 360 degree wrap around the time set stem (13).

19. The watch according to claim 18, wherein the time set stem (13) has two helicoidal elements (24, 24') which extend along the helicoidal zone (19) of the time set stem (13) and are angularly offset from one another by a constant interval spacing, and the at least two electrical contacts (14, 14') are separated from one another by a fixed distance (d); and the angularly offset of the two helicoidal elements and the distance (d) separating the at least two electrical contact elements (14, 14") are determined so that the electrical signals formed by the alternate opening and closing of the at least two electrical contact elements (14, 14'), upon rotation of the time set stem (13) at a constant speed, have a cyclical relationship that ranges from 30% to 70%.

20. The watch according to claim 18, wherein the time set stem (13) has three helicoidal elements (20, 20', 20") which extend along the helicoidal zone (19) of the time set stem (13) and are angularly offset from one another by a constant interval spacing, and the at least two electrical contact elements (14, 14') are separated from one another by a fixed distance (d); and the angularly offset of the three helicoidal elements and the distance (d) separating the at least two electrical contact elements (14, 14") are determined so that the electrical signals formed by the alternate opening and closing of each electrical contact element, upon rotation of the time set stem (13) at a constant speed, are essentially in quadrature.

* * * * *